US010534284B2

(12) United States Patent
Hirst et al.

(10) Patent No.: US 10,534,284 B2
(45) Date of Patent: Jan. 14, 2020

(54) EXPOSURE ADJUSTMENT FACTOR

(71) Applicant: HEWLETT-PACKARD DEVELOPMENT COMPANY, L.P., Houston, TX (US)

(72) Inventors: Mark Hirst, Boise, ID (US); Brad Larson, Boise, ID (US); Mark Shaw, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/570,991

(22) PCT Filed: Jul. 30, 2015

(86) PCT No.: PCT/US2015/042893
§ 371 (c)(1),
(2) Date: Oct. 31, 2017

(87) PCT Pub. No.: WO2017/019087
PCT Pub. Date: Feb. 2, 2017

(65) Prior Publication Data

US 2018/0364606 A1 Dec. 20, 2018

(51) Int. Cl.
*G03G 15/04* (2006.01)
*G03G 15/043* (2006.01)
*G03G 15/045* (2006.01)

(52) U.S. Cl.
CPC ..... *G03G 15/043* (2013.01); *G03G 15/045* (2013.01); *G03G 15/04045* (2013.01); *G03G 2215/0402* (2013.01)

(58) Field of Classification Search
None
See application file for complete search history.

(56) References Cited

U.S. PATENT DOCUMENTS

| | | | |
|---|---|---|---|
| 5,274,424 | A | 12/1993 | Hattori et al. |
| 5,950,043 | A | 9/1999 | Fujita et al. |
| 6,381,434 | B1 | 4/2002 | Yamamoto |
| 7,791,630 | B2 | 9/2010 | Stolkl et al. |
| 8,666,265 | B2 | 3/2014 | Ishihara et al. |

(Continued)

FOREIGN PATENT DOCUMENTS

| | | |
|---|---|---|
| CN | 102893220 | 1/2013 |
| CN | 103226306 | 7/2013 |
| CN | 105531631 | 4/2016 |

OTHER PUBLICATIONS

Briggs, et al. Analysis of Ghosting in Electrophotography, International Conference on Digital Printing Technologies. Oct. 16-19, 2000. British Columbia Canada.

*Primary Examiner* — Walter L Lindsay, Jr.
*Assistant Examiner* — Jessica L Eley
(74) *Attorney, Agent, or Firm* — Dicke Billig & Czaja PLLC

(57) ABSTRACT

An electrophotographic imager includes a photoconductive element, a charger, and a light source to expose areas of a charged surface of the photoconductive element to form a latent image. A development element is coupled relative to the photoconductive element to develop, via charged marking agent, the latent image on the photoconductive element. An exposure adjustment factor is selectively applied, prior to the exposing, to a first printable area of the latent image.

20 Claims, 7 Drawing Sheets

(56) References Cited

U.S. PATENT DOCUMENTS

| | | | | |
|---|---|---|---|---|
| 8,861,994 | B2 | 10/2014 | Ishii | |
| 8,879,933 | B2 | 11/2014 | Yamamoto | |
| 2001/0013939 | A1 | 8/2001 | Weaver et al. | |
| 2004/0131403 | A1* | 7/2004 | Nakamura | G03G 8/00 399/341 |
| 2004/0253014 | A1* | 12/2004 | Bares | G03G 15/5058 399/49 |
| 2010/0040389 | A1 | 2/2010 | Akatsu | |
| 2010/0150598 | A1 | 6/2010 | Thayer et al. | |
| 2013/0071131 | A1* | 3/2013 | Hirabayashi | G03G 15/5041 399/30 |

* cited by examiner

EXPOSURE ADJUSTMENT FACTOR

BACKGROUND

Digital electrophotographic imaging has already revolutionized document production. Yet, ever faster processing and higher volumes of imaging continue to pose challenges in achieving high quality images on printed documents.

DETAILED DESCRIPTION

Figure 1:
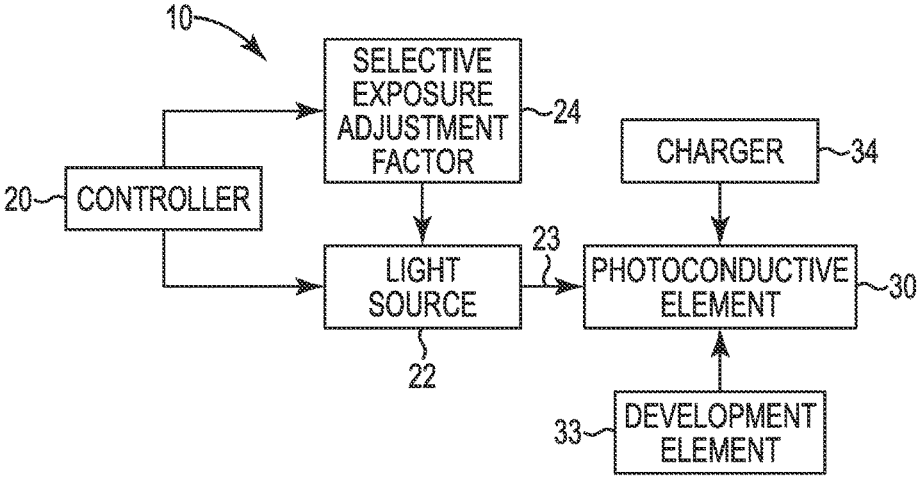
FIG. 1 is a block diagram schematically representing portions of an electrophotographic imager, according to one example of the present disclosure.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense. It is to be understood that features of the various examples described herein may be combined, in part or whole, with each other, unless specifically noted otherwise.

At least some examples of the present disclosure provide for performing electrophotographic imaging with reduced ghosting effects by employing an exposure adjustment factor. In some examples, such ghosting effects refer to an unintentional duplication of a portion of an image appearing within other portions of the same image.

In some examples, the exposure adjustment factor is selectively applied to a first printable area of the latent image, wherein the magnitude of the exposure adjustment factor is based at least on a marking agent transfer demand regarding a first evaluation portion of the latent image preceding the first printable area and on a development state of the developer element for the first evaluation portion. In some examples, the first evaluation portion immediately precedes the first printable area.

In some examples, the term "marking agent transfer demand" refers to an absolute or relative amount of marking agent to be transferred from the development element to the photoconductive element to achieve the intended amount of development of the latent image via the marking agent.

In some examples, an exposure adjustment factor refers to intentionally increasing or decreasing exposure of a portion of a latent image on a photoconductive element in addition to or after the electrophotographic imager makes it exposure calculation according to its normal operating procedures. In some examples, a magnitude of the exposure adjustment factor may be expressed via a percentage, such as percentage increase (e.g. 1%, 2%, 3%, 4%, 5%, 10%, etc.) in exposure above a nominal value for a given pixel or area according to the normal operating procedures or a percentage decrease (e.g. −1%, −2%, −3%, −4%, −5%, −10%, etc.) in exposure below the nominal value for a given pixel or area according to the normal operating procedures.

In some examples, the term "first" does not necessarily refer to an initial instance of a printable portion of the entire latent image or the first instance of an evaluation portion of the entire latent image, but rather the term "first" refers to portion of interest within the latent image for which adjustment may be applied. In some instances, the terms "portion" and "area" may be used interchangeable throughout the present disclosure without intending any substantive difference between the two terms.

In some examples, the first evaluation portion of the latent image comprises a second printable area of the latent image and the marking agent transfer demand is indicative of at least a pixel density of second printable area relative to a threshold.

In some examples, the first evaluation portion of the latent image comprises a non-printable area of the latent image, which also corresponds to at least one portion of the development element which has not been used for development for a prolonged period of time. In some examples, such prolonged non-development is expressed as a number of development cycles of the development element for which the non-development has occurred.

In some examples, prior to exposing the photoconductive element via a light source, the exposure adjustment factor is applied selectively to increase the amount of exposure (i.e. cause over-exposure) to thereby increase the degree of development of portions of an image that would otherwise be underdeveloped due to a relative marking agent transfer demand and/or the relative development state of at least some portions of the developer element.

In some examples, prior to exposing the photoconductive element via a light source, the exposure adjustment factor is applied selectively to decrease the amount of exposure to decrease the degree of development (i.e. to underdevelop) of portions of an image expected to develop within a target range, which in turn provides an overall compensation pattern to compensate for portions of an image expected to be underdeveloped due to the relative marking agent transfer demand and/or the relative development state of at least some portions of the development element.

In some examples, a combination of both of the previously described examples is employed to minimize unintentional underdevelopment and/or ghosting effects. For instance, some portions of an image which are expected to be underdeveloped will be purposely overexposed and some portions of the same image which are expected to be normally developed will be purposely underexposed.

In some examples, a decision whether to apply an exposure adjustment factor, and a magnitude of the exposure adjustment factor, is at least partially based on a difference between a marking agent transfer demand of the first printable area and a subsequent printable area.

In some examples, employment of the exposure adjustment factor is performed without otherwise altering the bias voltages of the developer and/or of the photoconductive element during an interpage gap interval, which would otherwise result in wasted marking agent and increased operating costs. In addition, in arrangements in which an interpage gap interval of the photoconductive element is relatively small, the selective application of the exposure adjustment factor (in accordance with some examples of the present disclosure) may be performed successfully whereas insufficient time may not be available to attempt correction via purging excess marking agent by altering the bias voltages of the development element and/or photoconductive element.

In some examples, employment of the exposure adjustment factor may account for and minimize the phenomenon of excessive marking agent charging and/or of unintentional undercharging regardless of where it might occur on an image to be printed. For instance, the selective application of the exposure adjustment factor can minimize unintentional underdevelopment and/or ghosting in a midportion of a printed image and is not limited to minimizing unintentional underdevelopment at the start of a printed page.

These examples, and additional examples, are described throughout the present disclosure in association with at least FIGS. 1-11.

FIG. 1 is a diagram schematically representing imaging via at least some portions of an electrophotographic imager 10, according to one example of the present disclosure. As shown in FIG. 1, a controller 20 of imager 10 uses image information to direct a light source 22 to expose a pattern of a latent image onto a charged photoconductive element 30, which is charged via charger 34. While not shown for illustrative simplicity, it will be understood that controller 20 also may direct operations of and/or cooperate with the charger 34, the photoconductive element 30, and a development element 33.

A development element 33 is coupled relative to the photoconductive element 30 to develop the latent image into a developed image for later transfer onto a media. However, prior to writing the image onto the photoconductive element 30, via a controller 20 the imager 10 employs a selective exposure adjustment factor 24 to modify the extent to which the light source 22 exposes select portions of the charged photoconductive element 30. In some examples, the location and magnitude of this modification is at least partially based on the extent to which at least some portions of the development element 33 have not been developed for a period of time and/or on an image-dependent marking agent transfer demand. In some examples, when used in association with the term "marking agent transfer demand", the term "image dependent" means that the absolute or relative amount of marking agent intended to be transferred (from the development element to the photoconductive element) depends on the particular image (or portion of the image) being developed. Further details regarding this arrangement are further described later in association with at least FIGS. 5A-11.

Figure 2:
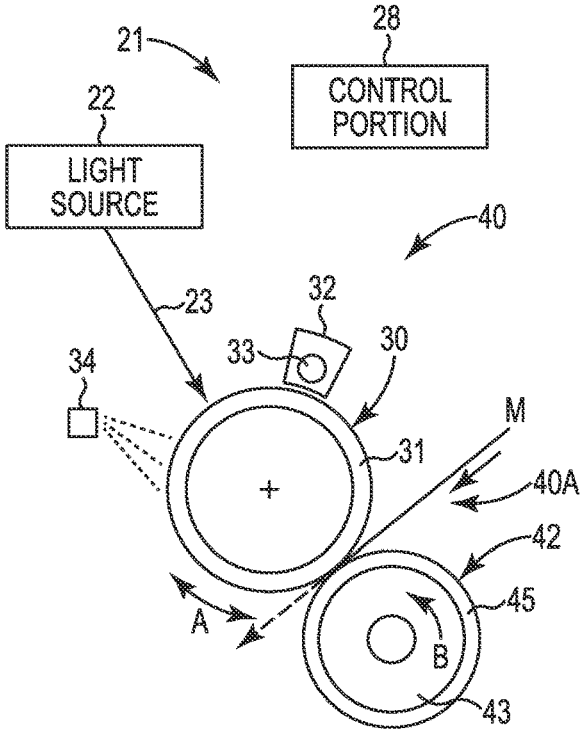
FIG. 2 is a side view schematically representing an electrophotographic imager, according to one example of the present disclosure.

FIG. 2 is a diagram including a side view schematically representing an electrophotographic imager 21, according to one example of the present disclosure. In one example, imager 21 includes at least some of substantially the same features and attributes of imager 10 (FIG. 1), with similar reference numerals referring to similar elements.

As shown in FIG. 2, one example of imager 21 comprises a light source 22, a photoconductive element 30 (e.g. a photoconductive cylinder), and a media roller 42. In addition, the imager 21 comprises a charger 34, and a developer 32 having development element 33. In some examples, the developer element 33 continuously provides repeating cycles of development. In some examples, the development element 33 comprises a development roller. In one aspect, the photoconductive element 30 includes an outer electrophotographic surface or plate 31 while the media roller 42 includes a blanket 45. In some examples, the surface or plate 31 comprises an organic photoconductor (OPC).

In some examples, imager 21 includes a control portion 28 to direct general operations of imager 21 and/or to implement the exposure adjustment factor 24 of FIG. 1. In some examples, control portion 28 includes at least some of the features and attributes of control portion 380, as described later in association with at least FIG. 8A.

While not shown in FIG. 1, in some examples, the imager 21 may additionally comprise excess "marking agent" collection mechanisms, cleaners, additional rollers, and the like. A brief description of the operation of the imager 21 follows.

In preparation to receive an image, as further shown in FIG. 2 the photoconductive element 30 receives a charge from charging station 34 (e.g., a charge roller or a scorotron) in order to produce a uniform charged surface on the electrophotographic surface 31 of the photoconductive element 30. Next, as the photoconductive element 30 rotates (as represented by directional arrow A), the light source 22 projects an image via beam 23 onto the surface 31 of photoconductive element 30, which discharges portions of the photoconductive element 30 corresponding to the image and thereby forms a latent image. These discharged portions are developed with a marking agent (such as but not limited to toner) via development element 33 to produce a "marking agent" image. As the photoconductive element 30 continues to rotate, the marking agent image is transferred onto media M passing through the pressure nip 40A between photoconductive element 30 and media roller 42.

While not shown in FIG. 2, it is understood that in some examples media roller 42 also acts as the media supply with the media M being wrapped about a cylinder 43 of media roller 42 to form the outer portion 45 of media roller 42. In some examples, media roller 42 releasably secures media M to a surface of media roller 42 as media M passes through the pressure nip 40A so that media M is wrapped around media roller 42 at pressure nip 40A.

In one aspect, the development element 33 electrically charges marking agent by friction via a tribo-charging process that is generally continuous during a printing process. In some instances, if a development element 33 is cycled (e.g. a roller is rotated) for relatively long periods of time without developing latent images, then the marking agent within the developer 32 at development element 33 can become excessively charged which makes it difficult to develop or transfer the marking agent (distributed on the surface of the development element 33) onto the photoconductive element 30. This behavior, in turn, makes the initial marking agent image formed on the photoconductive element 30 lighter in appearance than desired. In other words, the initial marking agent image is underdeveloped. After an area has been initially developed on the photoconductive element 30, the subsequent marking agent available at the development element 33 has lower amounts of electrical charge and is therefore easier to develop (i.e. transfer) onto the photoconductive element 30 so that the subsequently developed areas on the photoconductive element 30 appear darker, i.e. they develop closer to the intended darkness. This underdevelopment effect can happen anywhere on the printed page following long continuous runs of portions of a development element 33 without marking agent development, which in turn permits the marking agent on the development element 33 to become excessively charged. Moreover, after initial depletion of the excessively charged marking agent, the overcharging effect builds up again in a linear fashion as the development element 33 cycles until portions of the development element 33 are used again for development. At least some aspects of this phenomenon are illustrated in association with at least FIGS. 6A and 9-10 in the context of at least some examples of the present disclosure which overcome this phenomenon.

In some instances, upon a placing a relatively high demand of marking agent transfer (i.e. marking agent transfer demand) upon the development element 33 for a relative high pixel density region of a latent image, the relative amount of charge for marking agent on the development element 33 becomes significantly diminished such that the marking agent may be considered to be undercharged. With this undercharged marking agent condition, upon performing development of portions of the latent image subsequent to the high density pixel region, the subsequent portions may be overdeveloped due to excess marking agent transferring onto the photoconductive element. At least some aspects of this phenomenon are illustrated in association with at least FIG. 6C in the context of at least some examples of the present disclosure which overcome this phenomenon.

Figure 3:
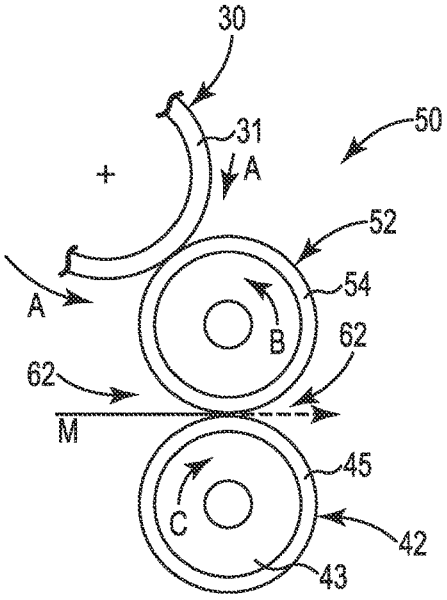
FIG. 3 is a partial side view schematically representing a transfer station of an electrophotographic imager, according to one example of the present disclosure.

FIG. 3 is a diagram including a side view of a portion of an electrophotographic imager 50, according to one example of the present disclosure. In one example, imager 50 includes substantially the same features and attributes of imager 21 (FIG. 2), except additionally comprising a transfer roller 52 interposed between the photoconductive element 30 and media roller 42. As in the prior example, a marking agent image is formed on the surface 31 of the photoconductive element 30. As the photoconductive element 30 continues to rotate, the developed marking agent image is transferred onto the electrically biased blanket 54 of the rotating transfer roller 52. Rotation of the transfer roller 50 (as represented by directional arrow B), in turn, transfers the developed marking agent image onto media M passing through the pressure nip 62 between transfer roller 50 and media roller 42.

Figure 4:
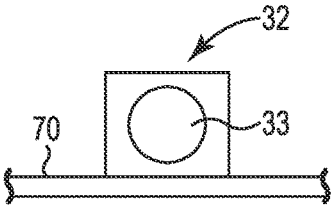
FIG. 4 is a side view schematically representing a developer coupled relative to a photoconductive belt, according to one example of the present disclosure.

FIG. 4 is a side view schematically representing a portion of an electrophotographic imager 71, according to one example of the present disclosure. Imager 71 includes features and attributes like imager 21 (FIG. 2) or imager 50 (FIG. 3), except for comprising a photoconductive belt 70 instead of a cylindrical photoconductive element 30 (as in FIGS. 2-3) with the development element 33 (e.g. a roller in some instances) being coupled relative to the photoconductive belt 70.

Figure 5B:
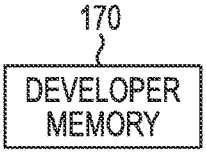
FIG. 5B is a block diagram schematically representing a developer memory, according to one example of the present disclosure.
Figure 5A:
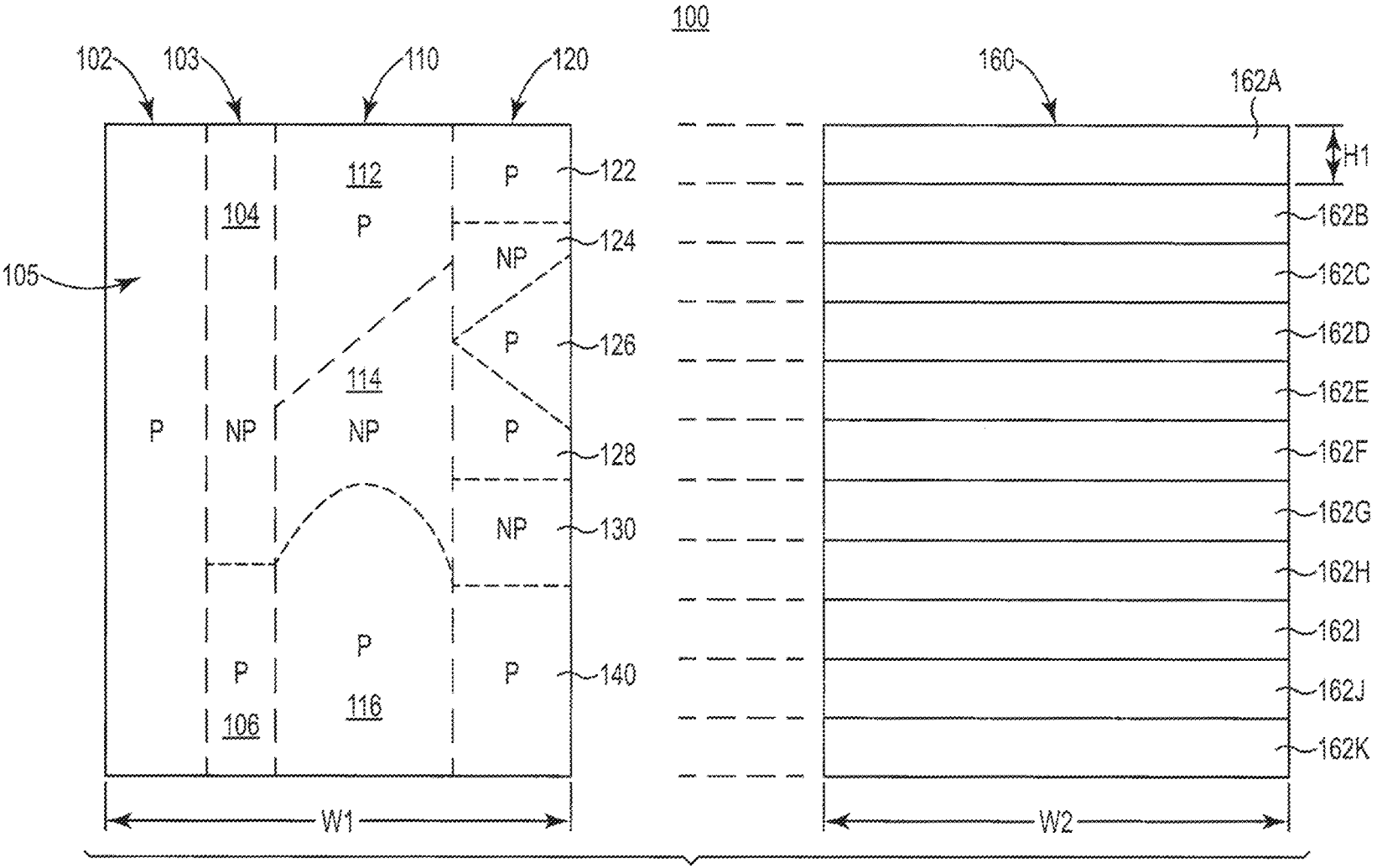
FIG. 5A is a diagram schematically representing an image map and an array of development maps, according to one example of the present disclosure.

FIG. 5A is a diagram 100 schematically representing a juxtaposition of an image 105 including printable portions (P) and non-printable (NP) portions 105 and a corresponding array 160 of development maps 162A-162K, according to one example of the present disclosure. Each respective map 162A-162K represents the development surface available upon a single cycle of development element 33 as the development element 33 continuously cycles during an imaging process. In some examples, when the development element 33 comprises a roller, each cycle corresponds to a revolution.

In one example, image 105 would be formed onto media by employing one of the electrophotographic imagers of FIGS. 1-4.

It will be understood that image 105 may include many different combinations and configurations of printable (P) portions and non-printable (NP) portions, and therefore image 105 in FIG. 5A provides just one of many example configurations.

In the example shown in FIG. 5A, image 105 includes adjacent columns 102, 103, 110, and 120 with at least some columns having different widths.

Column 102 includes printed portion (P) extending throughout a full length of column 102, while column 103 includes a non-printed portion 104 for a significant extent, which is then followed by a printed portion 106. Column 110 includes printed portion 112, non-printed portion 114, and printed portion 116. In one aspect, the respective printed and non-printed portions are not strictly limited to rectangular shapes but may have any desired shape or size. Similarly, column 120 includes multiple printed portions 122, 126, 140 and non-printed portions 124, 130 interposed therein.

As just one illustrative example, the respective printed and non-printed portions of column 120 are arranged in series along the direction of media travel during an imaging process.

As can be seen from FIG. 5A, most portions of image 105 include frequent variations between printed and non-printed portions. However, it can be seen from FIG. 5A that column 103 includes a relatively long stretch of non-printed portion 104 before printed portion 106 occurs. As will be further described later, this pattern may result in underdevelopment of printed portion 106 and would be suitable for application of an exposure adjustment factor (21 in FIG. 1) in accordance with at least some examples of the present disclosure.

Via the juxtaposition of image 105 relative to array 160 of maps 162A-162K, diagram 100 of FIG. 5A demonstrates a correspondence between the various printed (P) portions, non-printed (NP) portions of image 105 relative to the repeating cycles of development element 33. In some examples, the development element 33 has a width (W2) at least equal to a width (W1) of image 105, as represented in FIG. 5A. In some examples, a width of photoconductive element 30 is at least equal to or greater than the width (W1) of the image 105 and/or the width (W2) of development element 33.

In the particular example shown in FIG. 5A, image 105 may correspond to a standard U.S. Letter size (8.5"×11")

document and development element 33 may be sized such that it would take 11 cycles of development element 33 to help produce the full image 105. Accordingly, for a portion of image 105 such as column 103, a significant number (e.g. 7) of cycles of development element 33 would occur without marking agent development on photoconductive element 30. In the absence of an exposure adjustment factor in accordance with examples of the present disclosure, unintentional underdevelopment and/or ghosting may result from such situations, as further described later in association with at least FIGS. 6A and 9-10.

In at least some examples of the present disclosure, each respective map 162A-162K corresponds to the surface area of one cycle of the development element 33 and each map is employed to track pixels of the image 105 relative to a development state of the development element 33. As previously noted, in some examples the development element 33 has a surface area roughly 1/11th of the printed image 105. For purposes of mapping areas of the development element 33 where excessively charged marking agent resides, in some examples, a resolution of 75 dpi×75 dpi is employed. Assuming that 4 bits per "development element pixel" are used, a 32 kbyte memory buffer would be sufficient to map the development element 33 for keeping track of areas with excessively charged marking agent or with undercharged marking agent. Accordingly, by tracking pixels on the development element 33 one cycle at a time, a relatively small and manageable memory buffer may be employed to track excessively charged marking agent or undercharged marking agent on the development element 33.

Figure 8A:
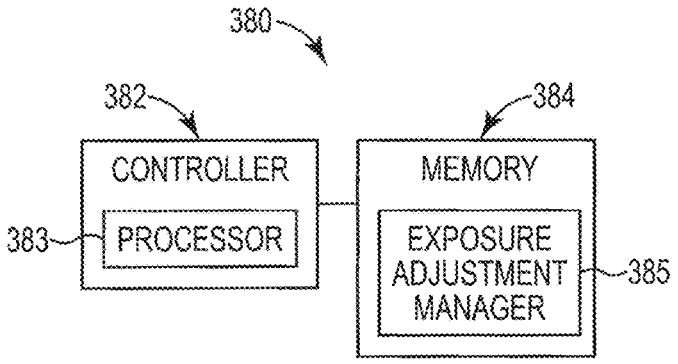
FIG. 8A is a block diagram schematically representing a control portion, according to one example of the present disclosure.

In some examples, the memory buffer resides in a developer memory 170, as shown in FIG. 5B. In some examples, developer memory 170 forms part of memory 384 in FIG. 8A or generally part of control portion 382 in FIG. 8A. However, in some examples, developer memory 170 in FIG. 5B is separate from, and independent of, memory 384 (FIG. 8A), although developer memory 170 may communicate with memory 384 or generally with control portion 382 (FIG. 8A).

In contrast, a full greyscale bit map of the entire image 105 (e.g. raster image) would involve a much larger memory source to track pixels regarding excessively charged marking agent. For example, for an image measuring 8.5"×11" at 1200 dpi×600 dpi printed resolution with 8 bits per YMCK pixel, the memory source would be 254 Mbytes (e.g. 64 Mbyte/color) per page.

Accordingly, by tracking charged marking agent via pixels corresponding to the physical size of the development element 33, a much smaller memory may be employed than would otherwise be involved if "charged marking agent" pixel tracking occurred for a given full size image.

In some examples, image 105 is larger or smaller than a U.S. Letter size document and/or development element 33 has a surface area other than $1/11^{th}$ of the image 105. Accordingly, when development element 33 comprises a roller, it may have a circumference other than one inch.

Figure 6A:
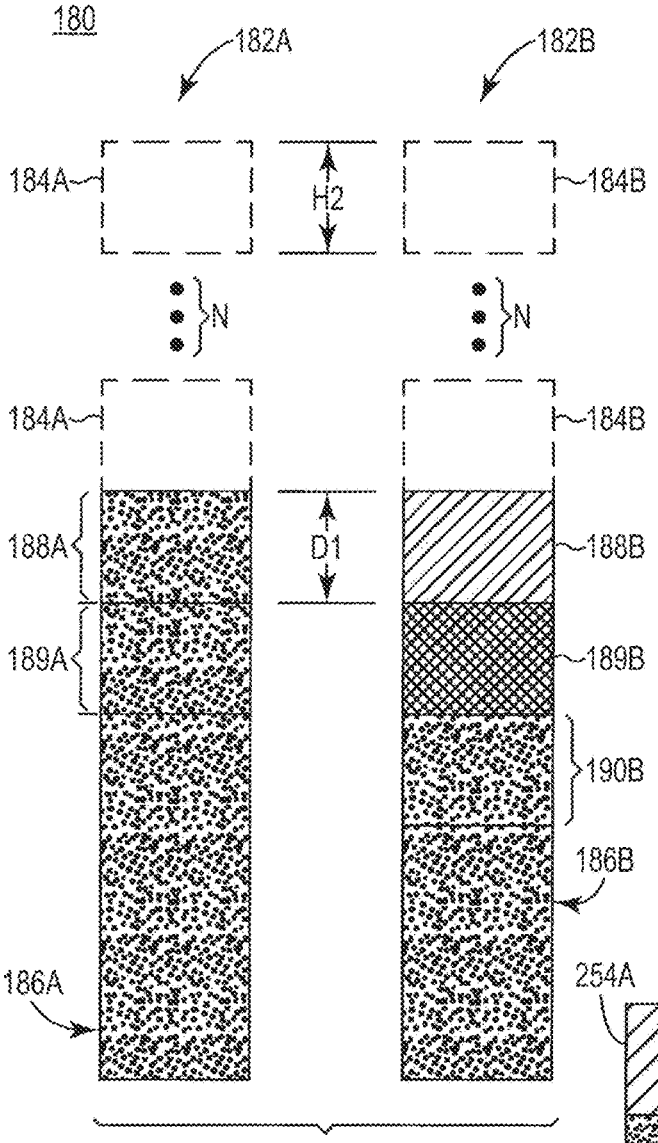
FIG. 6A is a diagram schematically representing a comparison of an intended image portion and an underdeveloped image portion, according to one example of the present disclosure.

FIG. 6A is a diagram 180 schematically representing a comparison of a portion 182A of an intended developed image and a portion 182B of an underdeveloped image, according to one example of the present disclosure. In one aspect, the underdeveloped image portion 182B corresponds to the appearance of a development and printing of the image in the absence of exposure adjustment via examples of the present disclosure. In another aspect, when exposure adjustment is applied, the actually developed image corresponds to the intended image portion 182A.

In some examples, portion 182A corresponds to a column or elongate portion of a larger image, such as but not limited to a full width page image. In one such example, portion 182A corresponds to column 103 in image 105 in FIG. 5. In some examples, portion 182A includes some number (n) of non-print segments 184A, at least some of which are succeeded by a high pixel density print region 186A. In some examples, at least some of the non-print segments 184A are immediately succeeded by a high pixel density print region 186A.

Figure 6B:
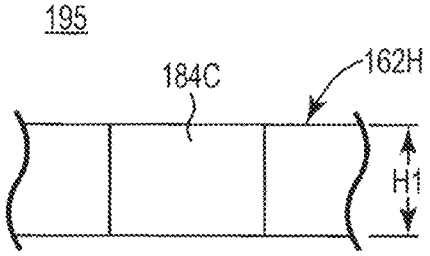
FIG. 6B is a diagram schematically representing a development portion, according to one example of the present disclosure.

In some examples, the height (H2) of each segment 184A corresponds to a surface for one cycle of the development element 33, which is represented by H1 in FIG. 5A or H1 in FIG. 6B. When a sufficient number (n) of non-print segments 184A would occur, then the development element 33 would have experienced several corresponding cycles (e.g. revolutions of a roller) of having not been developed, as represented by non-development portion 184C in development map 162H, as shown in the diagram 195 of FIG. 6B.

In some examples, at least the last non-print segment 184A before segment 188A comprises a first evaluation portion. In some instances, it is referred to as a first evaluation portion because it may be evaluated with respect to marking agent transfer demand and/or a development state of a development portion of the development element corresponding to the first evaluation portion. In some instances, this information regarding the first evaluation portion is used to determine whether to apply, and a magnitude of, an exposure adjustment factor for the first printable area (e.g. print segment 188A) that follows the first evaluation portion. In some examples, the first printable area immediately follows the first evaluation portion. As previously noted, in some examples the magnitude of the exposure adjustment factor is expressed or implemented as a percentage (e.g. 1%, 2%, 5%, 10%, etc.) of increased exposure (relative to a nominal target exposure per normal operating procedures) to compensate for the expected underdevelopment of the particular portions of the latent image.

In some instances, the non-print segments 184A can be viewed as an area having a pixel density of zero, and therefore a marking agent transfer demand of zero.

In this scenario of prolonged non-development, if the intended image portion 182A were actually printed without exposure adjustment, then portion 182B in FIG. 6A would result in which segments 188B, 189B of the high pixel density region 186B are underdeveloped due to excessive accumulation of tribo charges on the development element 33 resulting from an extended period of non-development of portion 184C. The extended period of non-development corresponds to the series of non-print segments 184B (which match non-print segments 184A). This situation results in less marking agent being developed onto photoconductive element 30 (FIGS. 1-4) such that segment 188B of image portion 182B is under-developed, as represented by the cross-hatching. In some examples, a decision to apply an exposure adjustment factor is based on expected underdevelopment that is a percentage (e.g., 5%, 10%, 20%. etc.) relative to a target amount of development under normal operating conditions, with the percentage being selectable by an operator or automatically via a control portion (e.g. 28 in FIG. 2 or 380 in FIG. 8A).

As represented by relatively denser cross-hatching in FIG. 6A, segment 189B represents a subsequent cycle of that portion 184C of the development element 33, and still exhibits some underdevelopment of the intended high pixel density region 186A (of intended image portion 182A). However, this subsequently developed segment 189B exhibits better development than the initial developed segment 188B because some volume of the excess charged marking agent on development element 33 has been removed via development of segment 188B. Finally, by the next cycle of the development element 33, the printed portion 190B exhibits the intended full development, as represented by the lack of cross-hatching. This behavior provides an indication that the portion of the development element 33 has returned toward a normal operating range regarding the amount of charged marking agent carried by the development element 33 because development onto photoconductive element 30 is now occurring frequently enough for that portion of development element 33.

While not shown in FIG. 6A, in some instances, additional underdeveloped segments may occur in underdeveloped image portion 182B subsequent to segments 188B, 189B.

In some examples, just one underdeveloped segment 188B in image portion 182B is present without a second underdeveloped segment 189B. This situation may arise where the non-development of a portion (e.g. portion 184C) of the development roller 33 is not as severe and/or where the high pixel density region 186A of the intended image portion 182A is less dense.

It will be understood that, in at least some examples, the high pixel density regions are involved in this phenomenon because of the relatively high degree of charge in those regions, which in turn place a higher demand on charged marking agent from the development element 33.

In some examples, a relative pixel density of a printable portion of an image refers to a pixel density being relatively higher or lower than a nominal pixel density for a latent image.

At least some examples of the present disclosure overcome the phenomenon that would be exhibited by underdeveloped portion 182B via selectively applying an exposure adjustment factor 24 (FIG. 1) to the intended image portion 182A prior to its exposure on the photoconductive element 30. In particular, upon a control portion (28 in FIG. 2 or 380 in FIG. 7) determining that non-development of at least a portion 184C of the development element 33 has exceeded a threshold (described further in association with FIGS. 7-8B), then the exposure adjustment factor 24 is implemented to adjust the exposure for at least the first segment 188A following the last non-printed region 184A (which corresponds to the prolonged non-developed portion 184C of the development element 33 (FIG. 6B)). In some examples, the first segment 188A immediately follows the last non-printed region 184A.

When such exposure adjustment is implemented according to at least some examples of the present disclosure, then the underdeveloped printed segments 188B, 189B are avoided and instead the intended image portion 182A is realized in which segments 188A, 189A of high pixel density region 186A will exhibit their expected appearance or a reasonably close approximation thereof.

Figure 7:
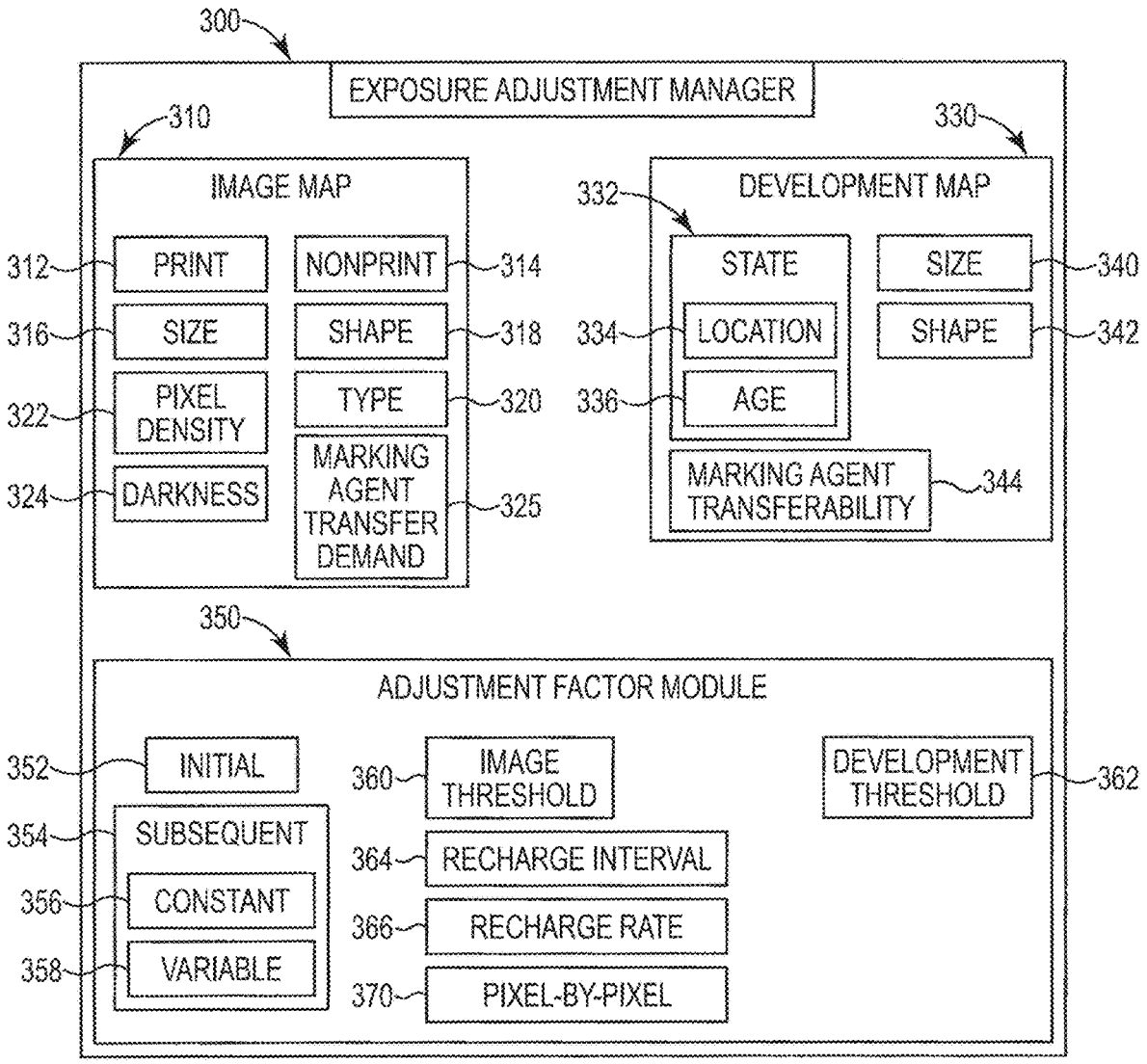
FIG. 7 is a block diagram schematically representing an exposure adjustment manager, according to one example of the present disclosure.

Further details regarding the manner in which this adjustment is implemented are described in association with the exposure adjustment manager 300 of FIG. 7.

Figure 6C:
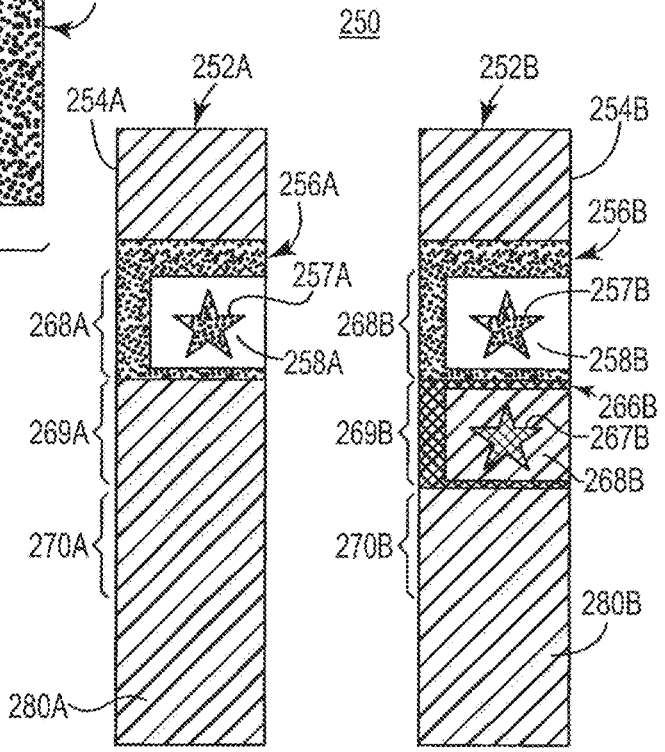
FIG. 6C is a diagram schematically representing a comparison of an intended image portion and an overdeveloped image portion, according to one example of the present disclosure.

FIG. 6C is a diagram 250 schematically representing a comparison of an intended developed image portion 252A and an overdeveloped image portion 252B, according to one example of the present disclosure. In one aspect, the overdeveloped image portion 252B corresponds to the appearance of a development and printing of the image in the absence of exposure adjustment via examples of the present disclosure. In another aspect, when exposure adjustment is applied, the actually developed image corresponds to the intended image portion 252A.

In some examples, portion 252A corresponds to a column (e.g. elongate portion) of a larger image, such as but not limited to a full width page image. In one such example, portion 252A corresponds to one of the columns in image 105 in FIG. 5. Portion 252A includes printable segments 254A, 268A, 269A, 270A, with segment 268A including at least one high pixel density print portion 256A, which in turn includes star portion 257A surrounded by non-print portion 258A. In some examples, the height (H2) of each segment 268A, 269A, 270A, etc. corresponds to a surface 1840 for one cycle of the development element 33, which is represented by H1 in FIG. 5A or H1 in FIG. 63. The area marked as 280A represents a general continuation of normal printing operations, in which neither underdevelopment nor overdevelopment occurs.

In this scenario, if the intended image portion 252A were actually printed without exposure adjustment, then portion 2523 in FIG. 6C would result in which star portion 257B, and surrounding non-print portion 258B would have the same appearance as star portion 257A and surrounding non-print portion 258A. As further shown in FIG. 6C, overdeveloped image portion 252B also would include segment 269B, which is overdeveloped due to undercharging of the development element 33 resulting from a preceding development of a high marking agent transfer demand for high pixel density segment 256B. In some examples, the development of the high pixel density segment 256B immediately precedes the segment 269B.

In some examples, at least 268A comprises a first evaluation portion. In some instances, it is referred to as a first evaluation portion because it may be evaluated with respect to marking agent transfer demand and/or a development state of a development portion of the development element corresponding to the first evaluation portion. In some instances, this information regarding the first evaluation portion is used to determine whether to apply, and a magnitude of, an exposure adjustment factor for the following segment 269A (e.g. a first printable area).

The situation illustrated in FIG. 60 involving segment 269A following high pixel density segment 268A results in more marking agent being developed onto photoconductive element 30 (FIGS. 1-4) such that segment 269B of image portion 252B is unintentionally over-developed due to undercharging, as represented by the darker cross-hatching of at least star portion 267B and general portion 266B, as compared to the lighter cross-hatching for segment 254B or 280B, for example. The star-surrounding portion 268B is shown with the same cross-hatching as segment 254B and/or segment 270B to represent neither underdevelopment nor overdevelopment.

While not shown in FIG. 6C, it will be understood that in some examples, at least one segment 270B subsequent to segment 269B may still exhibit some overdevelopment of the portion 270A of intended image portion 252A. However, this subsequently developed segment 270B would likely exhibit better development than the initial developed segment 269B because some volume of the intended degree of charged marking agent on development element 33 likely would have been restored.

Assuming that just one segment 269B exhibits overdevelopment, then subsequent segments such as segment 270B may exhibit the intended development, as represented by the nominal degree of cross-hatching shown for segments 254B, 270B, etc. This behavior provides an indication that the portion of the development element 33 has returned toward a normal operating range regarding the amount of charged marking agent carried by the development element 33.

While not shown in FIG. 6C, in some instances, additional overdeveloped segments may occur in overdeveloped image portion 252B subsequent to segments 269B.

It will be understood that, in at least some examples, the high pixel density regions are involved in this phenomenon because of the relatively high degree of charge used in those regions for development, which in turn place a higher demand on charged marking agent from the development element 33.

At least some examples of the present disclosure overcome the phenomenon that would be exhibited by overdeveloped portion 252B via selectively applying an exposure adjustment factor 24 (FIG. 1) to the intended image portion 252A prior to its exposure on the photoconductive element 30. In particular, upon a control portion (28 in FIG. 2 or 380 in FIG. 7) determining that marking agent transfer demand for portion may exceed a threshold (described further in association with FIGS. 7-8B), then the exposure adjustment factor 24 is implemented to adjust the exposure for at least the first segment 269A following the last high pixel density region 256A. 257A of segment 268A. In some examples, the first segment 269A immediately follows the last high pixel density region 256A, 257A of segment 268A.

When such exposure adjustment is implemented according to at least some examples of the present disclosure, then the overdeveloped printed segment 252B is avoided and instead the intended image portion 252A is realized in which segment 269A following high pixel density segment 268A will exhibit their expected appearance or a reasonably close approximation thereof.

Further details regarding the manner in which this adjustment is implemented are described in association with the exposure adjustment manager 300 of FIG. 7.

FIG. 7 is a block diagram of an exposure adjustment manager 300, according to one example of the present disclosure while FIG. 8A is block diagram of a control portion 380, according to one example of the present disclosure.

In general terms, the exposure adjustment manager 330 operates to provide selective adjustment of exposure of a photoconductive element (30 in FIG. 2) prior to development to counteract expected underdevelopment that may occur due to excessive charge buildup on the development element (33 in FIG. 2) because of prolonged non-development in particular region(s) of development element 33.

As shown in FIG. 7, in some examples, the exposure adjustment manager 300 comprises an image map module 310, a development map module 330, and an adjustment factor module 350.

In some examples, in general terms the image map module 310 provides a map of an image to be developed and printed. As shown in FIG. 7, in some examples image map module 310 comprises a print parameter 312, a non-print parameter 314, a size parameter 316, a shape parameter 318, a type parameter 320, a pixel density parameter 322, and a darkness parameter 324. The print parameter 312 identifies and tracks printable portions of the image while non-print parameter 314 identifies and tracks non-printable portions of the image (i.e. areas where no printing occurs). The size parameter 316, shape parameter 318, and type parameter 320 identify and track the size, shape and type of either printable portions or non-printable portions. The pixel density parameter 322 tracks a pixel density of each printable portion while the darkness parameter 324 tracks a darkness (e.g. gray level) of each printable portion. In some examples, the pixel density parameter 322 is associated with a pixel-by-pixel analysis of the image in order to determine whether an exposure adjustment factor should be applied, as described later in further detail.

In some examples, image map module 310 comprises a marking agent transfer demand factor 325 to determine and/or indicate a relative degree of marking agent transfer demand for a particular portion of an intended image. For instance, a high pixel density region may place a relatively high demand on a volume of marking agent to be transferred via development from development element 33 for a given cycle of development element 33. In some examples, the marking agent transfer demand factor 325 is associated with and/or utilizes the pixel density parameter 324 to make its determination.

In some examples, via parameters 316, 318, 320, a user may determine the size, shape, and/or type of the printable portions and non-printable portions to be tracked. In some examples, the size, shape, and/or type of the printable portions and non-printable portions are automatically determined based on the pixel density parameter 322 and/or darkness parameter 324.

In some examples, the development map module 330 generally operates to determine a relative degree of marking agent charge on the development element 33 during a continuous imaging process, which generally corresponds to a relative degree of development of charged marking agent onto photoconductive element 30.

As shown in FIG. 7, in some examples the development map module 330 comprises a state function 332, a size parameter 340, and a shape parameter 342. The state function 332 tracks a development state of a given portion of the development element 33. In some examples, state function 332 comprises a location parameter 334 and an age parameter 336. The location parameter 334 identifies a location on the development element 33 regarding the state of relative development (i.e. volume of charged marking agent present) while the age parameter 336 tracks the age (e.g. number of cycles or elapsed time) since the portion of the development element 33 at the particular location (per parameter 334) was last used to develop marking agent onto photoconductive element 30.

In some examples, the development map module 330 comprises a marking agent transferability parameter 344 to determine and/or indicate the extent to which marking agent can be transferred (e.g. developed upon photoconductive element 30) at a volume or rate within a target operating range. In some examples, the marking agent transferability parameter 344 is at least partially based on an available volume of charged marking agent, and its degree of charge, across a surface of development element 33. Accordingly, in some examples, the marking agent transferability parameter 344 may act as an indicator of the relative overcharging or relative undercharging of marking agent on the development element 33. In some examples, a value of the marking agent transferability parameter 344 may be evaluated relative to a target operating range of at least the development element 33.

In some examples, in general terms the adjustment factor module 350 operates to determine and implement adjustments in the degree of exposure (of light source 22) to photoconductive element 30 to compensate for relatively overcharged marking agent, which may be due to prolonged periods of non-development for some portions of a development element 33 (FIG. 1-2) or to compensate for relatively undercharged marking agent on development element 33, which may be due to a recent high marking agent transfer demand.

As shown in FIG. 7, in some examples the adjustment factor module 350 comprises an initial development parameter 352, a subsequent development parameter 354, an image threshold parameter 360, and a development threshold parameter 362. In some examples, the adjustment factor module 350 comprises a recharge interval parameter 364 and a recharge rate parameter 366. In some examples, adjustment factor module 350 includes a pixel-by-pixel analysis parameter 370.

In some examples, the initial development parameter 352 stores a value corresponding to the relative degree of exposure adjustment to occur for a printable segment to be initially developed after a prolonged period of non-development of the development element 33 for the particular portion of the development element 33 as in the example of FIG. 6A or after a high density pixel region as in the example of FIG. 6C.

Meanwhile, the subsequent development parameter 354 stores a value corresponding to the relative degree of exposure adjustment to occur for each subsequent printable segment(s) following the initial printable segment. In some examples, the stored value of exposure adjustment per the subsequent development parameter 354 is generally less than the value of the exposure adjustment per the initial development parameter 352, and in some instances, may be expressed as a fraction.

In some examples, the value of the exposure adjustment (per the subsequent development parameter 354) decreases in magnitude for each subsequent development.

In some examples, at least some subsequent exposure adjustments are greater in magnitude than the initial exposure adjustment.

In some examples, the subsequent development parameter 354 comprises a constant parameter 356 and a variable parameter 358. The constant parameter 356 maintains a constant magnitude of exposure adjustment to subsequent development instances regardless of how many subsequent development instances follow the initial development instance. The variable parameter 358 varies the magnitude of exposure adjustment to decrease in magnitude with each successive subsequent instance of development. In some examples, the variable parameter 358 operates according to a limit of a number of times (e.g. 2, 3, 4, etc.) the exposure adjustment will be applied to subsequent development instances.

In some examples, the image threshold parameter 360 provides a mechanism to select and track a threshold of pixel density (parameter 322) for which application of the exposure adjustment factor will be triggered. In particular, as an image is prepared for exposure onto the photoconductive element 30, it will be determined what the pixel density would be in a given area of the image, and if the intended pixel density exceeds a threshold and if other conditions warrant (e.g. development state of development element), then an exposure adjustment factor is applied. Conversely, when the intended pixel density of the image in a particular region is less than the threshold, then no exposure adjustment factor is applied.

It will be understood that in some examples at least the size and/or shape parameters 316, 318 regarding an image are employed to determine the size and/or shape of regions to which the image threshold per parameter 360 is applied.

In some examples, the development threshold parameter 360 provides a mechanism to select and track a threshold of non-development (parameter 362) of portions of development element 33 for which application of the exposure adjustment factor will be triggered. In particular, in some examples as an image is prepared for exposure onto the photoconductive element 30, the development state for portions of the development element 33 is determined for any high pixel density regions of the image (those exceeding the image threshold per parameter 360), and if the determined development state exceeds a threshold per parameter 362, then an exposure adjustment factor is applied. Conversely, in some examples, when the determined development state of the development element 33 in a particular region is less than the threshold 362, then no exposure adjustment factor is applied regardless of whether a corresponding portion of the image has a high pixel density or not.

It will be understood that in some examples at least the size and/or shape parameters 340, 342 regarding an area of non-development are employed to determine the size and/or shape of regions to which the development threshold parameter 362 may be applied. It will be further understood that in some examples, at least the size and/or shape parameters regarding an area of undercharged marking agent are employed to determine the size and/or shape of regions to which the development threshold parameter 362 may be applied.

In some examples, the development threshold parameter 362 employs a threshold at least partially based on a number of cycles of the development element 33 for which non-development has occurred for at least one portion of the development element 33. In some examples, the number of cycles is associated with or correlated with the age parameter 336 of the development state per state function 332.

In some examples, the development threshold parameter 362 employs a threshold at least partially based on a measurable charge field on the development element 33 or an elapsed time since the last development (in the particular region of interest for the development element 33).

In some examples, whether the exposure adjustment factor applied will depend on a recharge interval parameter 364 and/or recharge rate 366 (FIG. 7), which may form part of exposure adjustment module 350. The recharge interval parameter 364 tracks the interval (e.g. how often) at which the development element 33 is recharged. In particular, in some examples, in situations in which the recharge interval is low enough or less than an interval threshold, then unintentional underdevelopment and/or ghosting due to prolonged non-development of the development element 33 likely will not occur. Therefore, in these situations, an exposure adjustment factor will not be applied. However, in some examples, where the recharge interval is high enough to exceed a threshold to create situations in which such underdevelopment and/or ghosting would be more likely to occur, then an exposure adjustment factor will be applied.

In some examples, information regarding the recharge rate and/or recharge interval can affect whether overdevelopment may occur following a high pixel density region of an intended image, and therefore can at least partially determine whether a selective exposure adjustment factor may be applied.

The recharge rate parameter 364 tracks the speed (e.g. how quickly) at which the development element 33 is recharged each time that re-charging occurs. In particular, in situations in which the recharge rate is low enough or less than a rate threshold, then underdevelopment and/or ghosting due to prolonged non-development of the development element 33 likely will not occur. Therefore, in these situations, an exposure adjustment factor will not be applied. However, where the recharge rate is high enough to exceed a threshold to create situations in which such underdevelopment and/or ghosting would be more likely to occur, then an exposure adjustment factor will be applied.

In some examples, the recharge interval parameter 364 and/or recharge rate 366 are not subject to modification. In some examples, these parameters 364, 366 may be modified via exposure adjustment manager 300 in order to at least partially control or compensate for potential underdevelopment and/or ghosting issues.

With at least some general aspects of operation of the exposure adjustment manager 300 in mind, more specific examples of implementing an exposure adjustment factor will be described. In some examples, decisions regarding application of an exposure adjustment factor are made via a pixel-by-pixel analysis per pixel-by-pixel parameter 370, as shown in FIG. 7.

For illustrative purposes, some examples will be described with regard to underdevelopment related to prolonged non-development of at least some portions of the development element, and the associated overcharging of marking agent on development element 33. However, it will be understood that at least some of substantially the same principles may be applied to some examples regarding overdevelopment due to undercharged marking agent on development element 33 related to high marking agent transfer demands forced by high pixel density regions of an intended image.

For instance, when printing starts, the exposure system associated with light source 22 uses image information 20 (FIG. 1) (available in a pixel frame buffer) to set the initial exposure of an individual pixel to be written. Before this pixel is released (via the control portion 28) for writing by light source 22, the pixel is scaled by the exposure adjustment factor (24 in FIG. 1 and per manager 300 in FIG. 7) based on the information in a developer memory 170 (FIG. 5B) associated with at least the development element 33. In some examples, the stored information corresponds to the state of excessive charge that exists on the marking agent in the area of the image to be written.

In some examples, a magnitude of the adjustment of the exposure for the to-be-written pixel also is at least partially based on the values of excessive charged marking agent for each surrounding pixel (e.g. a 4×4 sample). In some examples, a different magnitude adjustment is made depending on whether a solid area (of which the pixel forms a part) is being exposed, a single pixel is being exposed, or halftoned areas are being exposed. After the to-be-written pixel is released (via control portion 28 in FIG. 2) to be written by light source 22, the developer memory 170 (FIG. 5B) corresponding to the "development element" pixel area is updated to reflect the decreased amount of excessively charged marking agent available on that area of the development element 33. The process then continues down the page with the development state (such as via state function 332 in FIG. 7) of marking agent charge information being continuously updated.

It will be further understood that non-developed areas of marking agent on development element 33 pick up additional charge on each rotation of the roller 33. Accordingly, in some examples, this phenomenon is tracked to increase the accuracy of tracking the excess charge level on development element 33, and thereby increase the accuracy of the exposure adjustment factor. Accordingly, in some examples, a memory (e.g. 170 in FIG. 5B) associated with tracking "marking agent charge" pixels on the development element 33 accounts for the number of cycles of development element 33 since an area was last depleted of excessively charged marking agent. In some examples, developer memory 170 (FIG. 5B) employs an additional 4 bits per pixel such that a total of 8 bits per "development element" pixel area is employed to result in a 64 k memory buffer per development element 33.

It will be understood that these examples of memory size are illustrative and not limiting, as the memory size may depend on the size and/or shape of the development element 33 as well as other factors.

With at least some examples employing a pixel-by-pixel exposure adjustment, the phenomenon of underdevelopment of image portions (e.g. segment 188B in FIG. 6A) due to excessively charged marking agent on development element 33 may be addressed continuously throughout the printing process during formation of an image instead of merely occurring at the start of an image. Accordingly, adjustments can be made within any portion of a page between a top and a bottom of the page.

Moreover, in one aspect, at least some examples of the present disclosure may minimize underdevelopment and/or subsequent ghosting without unnecessarily wasting marking agent as would otherwise occur upon purging excess charged marking agent into an interpage gap of each page of a print job.

Accordingly, at least some examples of the present disclosure may reduce operating costs for the customer by saving marking agent. Moreover, by foregoing such purging activity, at least some examples of the present disclosure may enable use of a much smaller interpage gap, which in turn allows for higher effective print speed without speeding up the actual paper speed or the speed of any of the electrophotographic imaging process components. This, in turn, may prolong the life of all of the electromechanical parts of the electrophotographic imaging system.

In addition, by enabling use of a smaller interpage gap, at least some examples of the present disclosure solution may decrease the energy consumption involved in printing at a higher effective print speed because the physical space between each page is smaller for a given print speed. In addition, less "idle" time occurs in situations in which the print process is in operation but nothing is being printed on a page.

With at least some examples employing a pixel-by-pixel exposure adjustment, the phenomenon of overdevelopment of image portions (e.g. segment 269B in FIG. 60) due to undercharged marking agent on development element 33 may be addressed continuously throughout the printing process during formation of an image instead of merely occurring at the start of an image. Accordingly, adjustments can be made within any portion of a page between a top and a bottom of the page. Moreover, in one aspect, at least some examples of the present disclosure may minimize overdevelopment and/or subsequent ghosting.

FIG. 8A is a block diagram schematically illustrating a control portion 380, according to one example of the present disclosure. In some examples, control portion 380 includes a controller 382 and a memory 384. In some examples, control portion 380 provides one example implementation of control portion 28 of imager 21 in FIG. 2.

In general terms, controller 382 of control portion 380 comprises at least one processor 383 and associated memories. The controller 382 is electrically couplable to, and in communication with, memory 384 to generate control signals to direct operation of at least some components of the systems, components, and modules described throughout the present disclosure. In some examples, these generated control signals include, but are not limited to, employing exposure adjustment manager 385 stored in memory 384 to manage unintentional underdevelopment, unintentional overdevelopment, and/or related ghosting for an electrophotographic imager in the manner described in at least some examples of the present disclosure. It will be further understood that control portion 380 (or another control portion) may also be employed to operate general functions of an electrophotographic imager. In some examples, exposure adjustment manager 385 comprises at least some of substantially the same features as exposure adjustment manager 300, as previously described in association with at least FIG. 7.

In response to or based upon commands received via a user interface (e.g. user interface 386 in FIG. 8B) and/or via machine readable instructions, controller 382 generates control signals to implement an exposure adjustment factor in accordance with at least some of the previously described examples and/or later described examples of the present disclosure. In some examples, controller 382 is embodied in a general purpose computer while in other examples, controller 382 is embodied in the electrophotographic imager (10 in FIG. 1; 21 in FIG. 2) generally or incorporated into or associated with at least some of the components described throughout the present disclosure, such as control portion 28 (FIG. 2).

For purposes of this application, in reference to the controller 382, the term "processor" shall mean a presently developed or future developed processor (or processing resources) that executes sequences of machine readable instructions contained in a memory. In some examples, execution of the sequences of machine readable instructions, such as those provided via memory 384 of control portion 380 cause the processor to perform actions, such as operating controller 382 to implement an exposure adjustment factor, as generally described in (or consistent with) at least some examples of the present disclosure. The machine readable instructions may be loaded in a random access memory (RAM) for execution by the processor from their stored location in a read only memory (ROM), a mass storage device, or some other persistent storage (e.g., non-transitory tangible medium or non-volatile tangible medium, as represented by memory 384. In some examples, memory 384 comprises a computer readable tangible medium providing non-volatile storage of the machine readable instructions executable by a process of controller 382. In other examples, hard wired circuitry may be used in place of or in combination with machine readable instructions to implement the functions described. For example, controller 382 may be embodied as part of at least one application-specific integrated circuit (ASIC). In at least some examples, the controller 382 is not limited to any specific combination of hardware circuitry and machine readable instructions, nor limited to any particular source for the machine readable instructions executed by the controller 382.

Figure 8B:
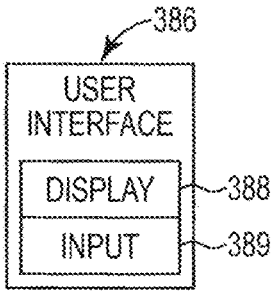
FIG. 8B is a block diagram schematically representing a user interface, according to one example of the present disclosure.

In some examples, user interface 386 comprises a user interface or other display that provides for the simultaneous display, activation, and/or operation of at least some of the various components, modules, functions, parameters, features, and attributes of control portion 380 and/or the various aspects of an electrophotographic imager, as described throughout the present disclosure. In some examples, at least some portions or aspects of the user interface 486 are provided via a graphical user interface (GUI). In some examples, as shown in FIG. 8B, user interface 386 includes display 388 and input 389.

Figure 9:
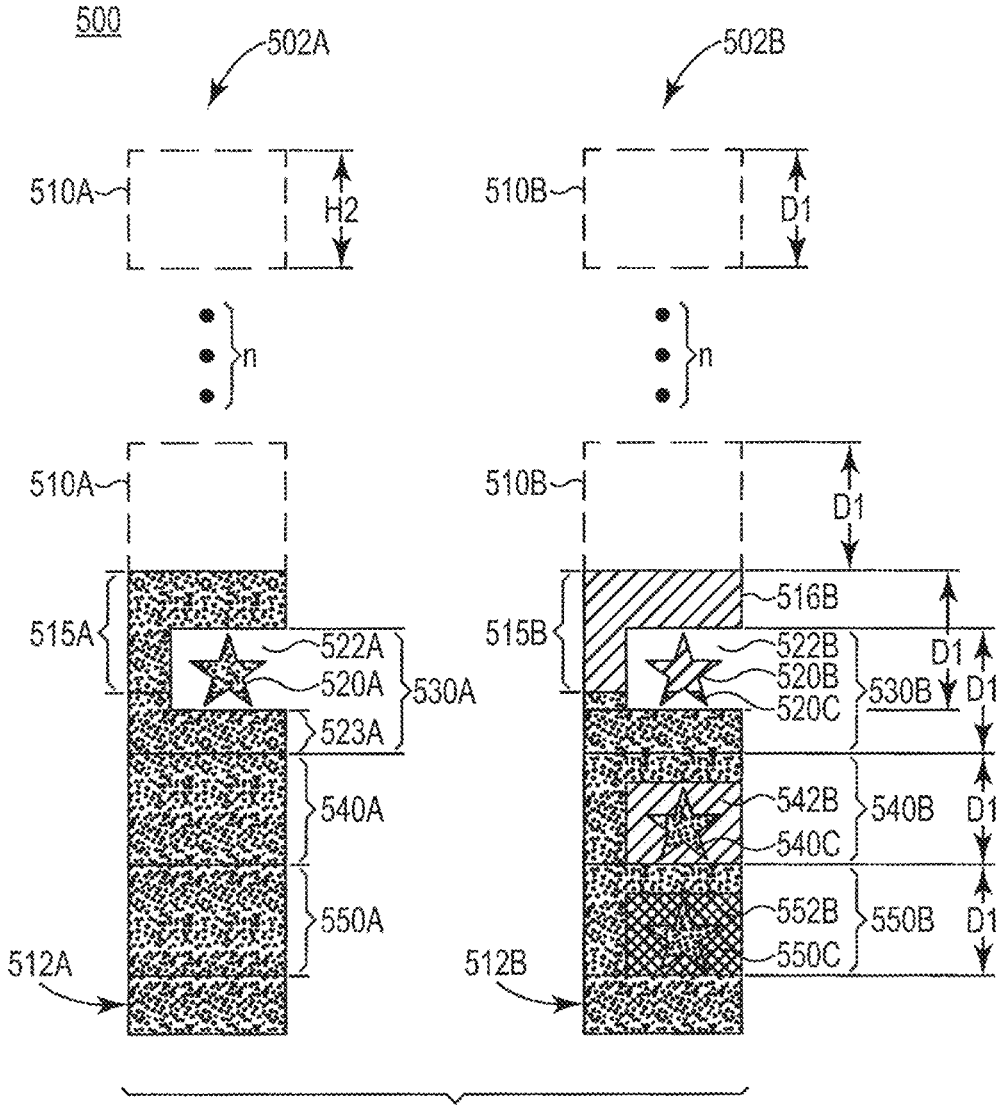
FIG. 9 is a diagram schematically representing a comparison of an intended image portion and an underdeveloped image portion, according to one example of the present disclosure.

FIG. 9 is a diagram schematically representing a comparison of an intended image portion and an underdeveloped image portion, according to one example of the present disclosure.

In some examples, the example of FIG. 9 comprises at least some of substantially the same features and attributes of the operation of the exposure adjustment factor as in the example of FIG. 6A-6B.

As shown in FIG. 9, a diagram 500 schematically representing a comparison of a portion 502A of an intended image and a portion 502B of an underdeveloped image, according to one example of the present disclosure. In one aspect, the underdeveloped image portion 502B corresponds to the appearance of developing the intended image in the absence of exposure adjustment via examples of the present disclosure. In another aspect, when exposure adjustment is applied in accordance with at least some examples of the present disclosure, an actually developed image will generally correspond to the intended image portion 502A.

Like the example in FIG. 6A, in some examples, portion 502A corresponds to a column or elongate portion of a larger image with portion 182A including some number (n) of non-print segments 510A, which are succeeded by a high pixel density print region 512A. In some examples, number (n) of non-print segments 510A are immediately succeeded by high pixel density print region 512A. In one aspect, the high pixel density print region 512A includes a first or initial segment 515A, a portion of which includes the star portion 520A and one non-print portion 522A surrounding a high pixel density star 520A, i.e. the "star-surrounding" portion. In another aspect, for purposes of discussion the high pixel density region 512A is apportionable into other segments such as segments 530A, 540A, and 550A with segment 530A also including the star 520A, star-surrounding non-print portion 522A, and lower print portion 523A. Meanwhile, segments 540A, 550A comprise high pixel density regions lacking any non-print portions.

In some examples, the height (H2) of each segment 510A corresponds to a circumference of the development element 33, which is represented by H1 in FIG. 5A or D1 in FIG. 9. When a sufficient number (n) of non-print segments 510A would occur, then the development element 33 would have experienced several corresponding cycles of having not been developed such that an excessively non-developed portion 184C of development element 33 may exist, as represented in the diagram 195 of FIG. 6B.

In this scenario, if the intended image portion 502A were actually developed without an exposure adjustment, then portion 502B in FIG. 9 would result in which initial segment 515B (including upper star portion 5208) of the high pixel density region 512B is underdeveloped due to excessive accumulation of tribo charges on the development element 33 resulting from an extended period of non-development of portion 184C (FIG. 6B). The extended period of non-development corresponds to the series of non-print segments 510B (which match non-print segments 510A). This situation results in less marking agent (e.g. toner) being developed onto the portion 184C of development element 33 (FIGS. 1-4) such that segment 515B (including upper star portion 520B) of image portion 182B is being under-developed, as represented by the cross-hatching.

In this example, segment 530E includes the surrounding non-print portion 522B (which surrounds upper star portion 520B and lower star portion 520C), which still corresponds to a non-developed portion of the development element 33 (FIG. 2) such that upon a subsequent cycle of development element 33 (FIG. 2), an underdeveloped portion 542B (which surrounds fully developed star portion 540B) occurs because the surrounding portion 542B effectively defines an initial development portion following the last instance (portion 522B) of an area of prolonged non-development of development roller 33.

As represented by the relatively denser portion of cross-hatching in FIG. 9, segment 550E represents a subsequent cycle of the same portion of the development element 33, and still exhibits underdevelopment of the intended high pixel density region 512A (of intended image portion 502A). The surrounding portion 552B of the subsequently developed segment 550B exhibits better development than the initial developed "star-surrounding" portion 542B that surrounded star portion 540C in segment 540. Finally, by the next cycle of the development element 33, the printed portion following segment 550E exhibits the intended full development, as represented by the lack of cross-hatching in the remainder of the region 512B. This indicates that the particular portion of the development element 33 has returned toward a normal operating range regarding the amount of charged marking agent carried by the development element 33 because development is now occurring frequently enough in that portion of development element 33.

In some examples, additional underdeveloped segments may occur subsequent to segment 5503 in which another "star-surrounding" portion would appear as an underdeveloped portion within the otherwise fully developed high pixel density region 5123.

In some examples, just one underdeveloped segment 540B (including "star-surrounding" portion 542B) is present without a second underdeveloped segment 550B (including star portion 550C and "star-surrounding" portion 552B). This situation may arise where the non-development of a portion of the development roller 33 is not as severe and/or where the high pixel density region of the intended image is less dense.

With this in mind, at least some examples of the present disclosure overcome the phenomenon that would be otherwise be exhibited by the underdeveloped image portion 502B via selectively applying an exposure adjustment factor 24 (FIG. 1) to the intended image portion 502A prior to its exposure on the photoconductive element 30. In particular, upon control portion (28 in FIG. 2 or 380 in FIG. 7) determining that non-development of at least a portion 184C of the development element 33 has exceeded a threshold (previously described in association with FIGS. 7-8B), then the exposure adjustment factor 24 is implemented to adjust the exposure for at least the first segment 515A following the last non-printed region 510A (which in turn corresponds to the prolonged non-developed portion 184C of the development element 33 (FIG. 6B)). In some examples, first segment 515A immediately follows that last non-printed region 510A.

Employment of the exposure adjustment factor will compensate for the prolonged non-development state of portions of the development element 33 and thereby avoid the underdevelopment that would otherwise be exhibited in segment 515B (as portion 516B, and as upper star portion 520B), in segment 540B (as "star-surrounding" portion 542B), and in segment 550B (as "star surrounding" portion 552B) in FIG. 9.

When such exposure adjustment is implemented according to at least some examples of the present disclosure, then the electrophotographic imager avoids producing an underdeveloped print segment 515B (including portions 516B, 520B), underdeveloped segment 540B (including "star-surrounding" portion 542B), and underdeveloped segment 550B (as "star-surrounding" portion 552B) in FIG. 9. Instead, the intended image portion 502A is achieved in which all the segments of high pixel density region 512A (including the non-printed area surrounding the star 520A) will exhibit their expected appearance (or a reasonably close approximation thereof).

As noted in connection with FIG. 6A, these adjustments for the example of FIG. 9 may be implemented via the exposure adjustment manager 300 and/or control portion 382, as previously described in association with at least FIG. 7.

Figure 10:
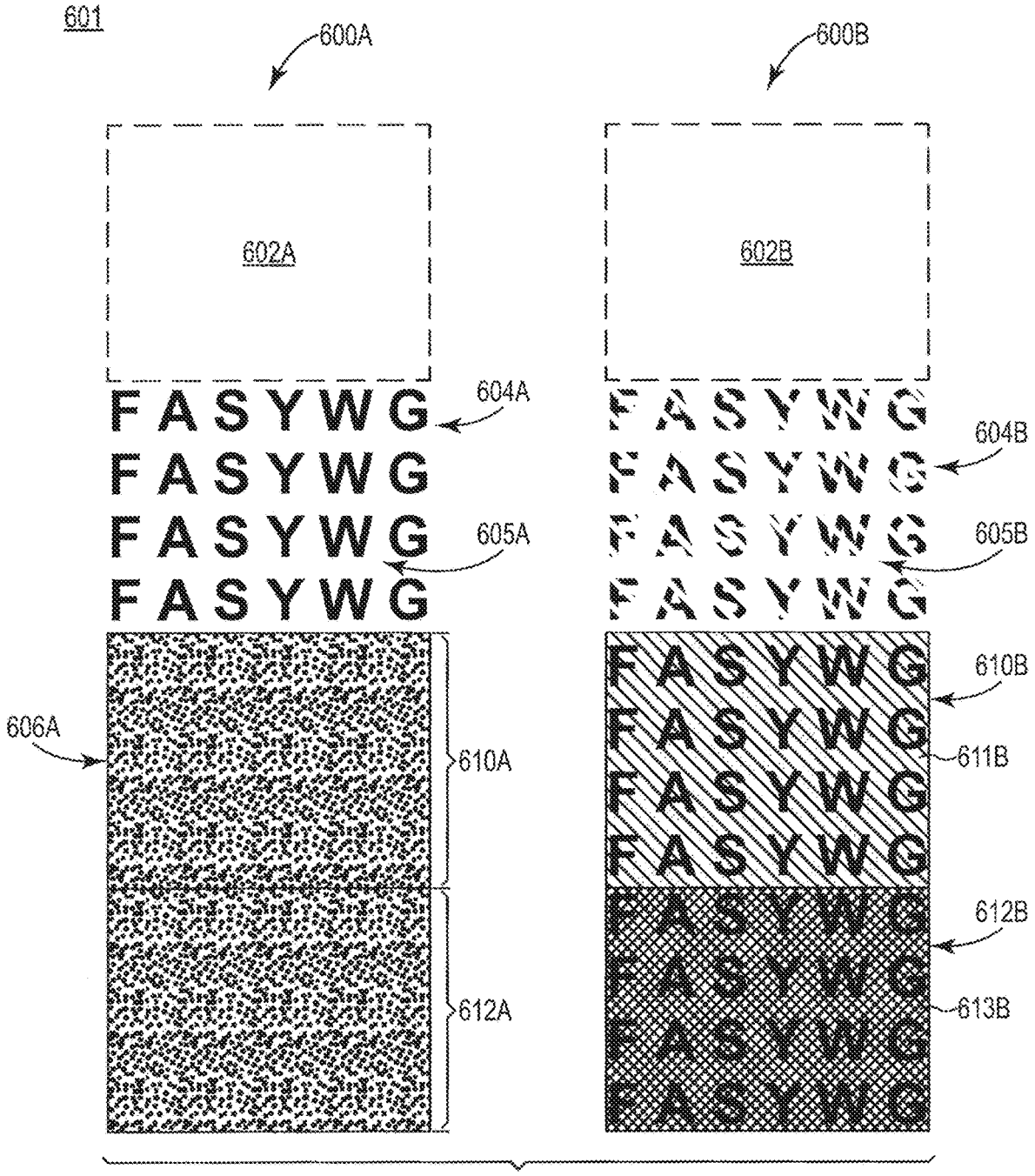
FIG. 10 is a diagram schematically representing a comparison of an intended image portion and an underdeveloped image portion, according to one example of the present disclosure.

FIG. 10 is a diagram 601 of an intended image portion 600A and an underdeveloped image portion 600B, according to one example of the present disclosure. In manner substantially the same as previously described in association with the examples of FIGS. 6A and 9, via employing an exposure adjustment factor prior to exposure of the photoconductive element, underdeveloped image portion 600B is avoided and proper development of the intended image 600A occurs.

In a manner similar to the examples of FIG. 6A or FIG. 9, FIG. 10 depicts intended image portion 600A and underdeveloped image portion 600B having at least one non-print segment 602A and 602B, respectively, preceding an initial print region 604A, 604B.

However, unlike the prior examples of FIG. 6A or FIG. 9, FIG. 10 depicts that intended image portion 600A includes an initial print region 604A comprising an array of text characters following by a relatively homogenous high pixel density region 606A. Like the prior examples of FIG. 6A or FIG. 9, in the absence of an exposure adjustment factor (in accordance with examples of the present disclosure), the underdeveloped image portion 600B would otherwise exhibit an underdeveloped segment 604B of the text characters and a non-print, text-surrounding portion 605B.

Segment 604B is followed by a subsequent segment 610B having a "text-surrounding" portion 611B (the areas surrounding the printed text characters) which appears as an underdeveloped image in a region which should appear as a relatively uniform high pixel density segment 610A.

In particular, the "text-surrounding" portion 611B in segment 610B corresponds to an initial development instance for high pixel density segment 610A that follows the last iteration/Instance of the non-developed portion 605A, which surrounds the text characters in segment 604A. In some examples, the "text-surrounding" portion 611B immediately follows the last iteration/instance of the non-developed portion 605A.

In one aspect, the underdevelopment of the text-surrounding portion 611B results in a ghost of the text characters of the segment 604B in the at least the sense that the text characters from segment 604B make an unintended and undesired appearance in at least segment 610B.

As further shown in FIG. 10 by a relatively denser cross-hatching, a subsequent segment 612B of underdeveloped image portion 600B would still exhibit an underdeveloped "text-surrounding" portion 613B, but with relatively more development than in segment 612B. This situation also results in a ghost of the text characters of segment 604B making an unintended and undesired appearance in segment 612B.

As in the prior examples of FIGS. 6A and 9, the underdeveloped "text-surrounding" portions 611B and 613B may be generally avoided or significantly diminished via employing an exposure adjustment factor in association with at least FIG. 1 and FIGS. 7-8A to thereby produce the intended image portion 600A.

Figure 11:
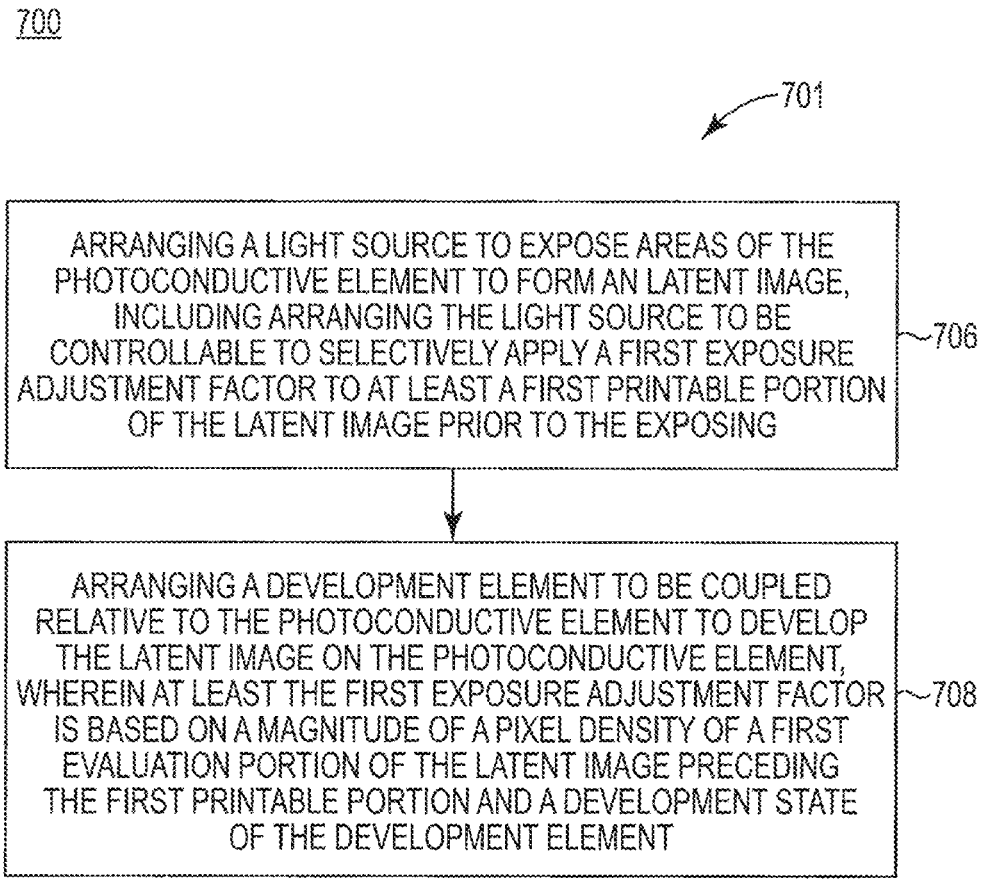
FIG. 11 is a flow diagram schematically representing a method of manufacturing an electrophotographic imager, according to one example of the present disclosure.

FIG. 11 is a flow diagram 700 of a method 701 of manufacturing an electrophotographic imager, according to one example of the present disclosure. In some examples, method 701 may be performed via at least some of the components, modules, functions, parameters, and systems as previously described in association with at least FIGS. 1-10. For instance, in some examples, method 701 may be performed via imager 10 (FIG. 1) with controller 20 (FIG. 1), imager 21 (FIG. 2) with control portion 28 (FIG. 2), and/or controller 382 (FIG. 8A) with exposure adjustment manager 385 (FIG. 8A). In some examples, method 701 may be performed via at least some components, modules, functions, parameters, and systems other than those previously described in association with at least FIGS. 1-10.

As shown in FIG. 11, at 706 method 701 includes arranging a light source to expose areas of a chargeable surface of a photoconductive element to form a latent image, including arranging the light source to be controllable to selectively apply a first exposure adjustment factor to at least a first printable portion of the latent image. In some examples, method 701 further comprises applying at least one second exposure adjustment factor to at least one subsequent printable portion of the latent image.

At 708, method 701 includes arranging a development element to be coupled relative to the photoconductive element to develop the latent image on the photoconductive element with a marking agent (e.g. toner). In one aspect, at least the first exposure adjustment factor is based at least on a magnitude of a pixel density of a first evaluation portion of the latent image preceding the first printable area and a development state of the development element. In some examples, the first evaluation portion immediately precedes the first printable area. In some examples, at least the second exposure adjustment factor also is based at least on a magnitude of a pixel density of a first evaluation portion of the latent image preceding the first printable area and a development state of the development element. In some examples, the first evaluation portion immediately precedes the first printable area.

At least some examples of the present disclosure provide for electrophotographic imaging with reduced underdevelopment, reduced overdevelopment, and/or ghosting effects by employing an exposure adjustment factor.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein.

The invention claimed is:

1. An electrophotographic imager comprising:

a photoconductive element;

a charger to charge a surface of the photoconductive element;

a light source to expose areas of the charged surface to form a latent image;

a development element coupled relative to the photoconductive element to develop, via charged marking agent, the latent image on the photoconductive element; and a controller to selectively apply an exposure adjustment factor to a first printable area of the latent image, wherein a magnitude of the exposure adjustment factor is based on a marking agent transfer demand regarding a first evaluation portion of the latent image preceding the first printable area and on a development state of the development element for the first evaluation portion, wherein the marking agent transfer demand indicates the volume of marking agent to be transferred via development of the first evaluation portion of the latent image, the volume of marking agent based on a pixel density parameter of a printable portion of the latent image, and wherein the development state of the development element is based on a location on the development element with respect to the volume of the charged marking agent and with respect to an age since last development usage at the location on the development element.

2. The electrophotographic imager of claim 1, wherein the first evaluation portion of the latent image comprises a second printable area of the latent image, wherein the marking agent transfer demand corresponds to at least a pixel density of second printable area.

3. The electrophotographic imager of claim 1, wherein the first evaluation portion of the latent image comprises a non-printable area of the latent image, which corresponds to at least one non-developed area of the development element.

4. The electrophotographic imager of claim 1, wherein the controller is associated with a memory to store a map, on a pixel-by-pixel basis, regarding the development state of the development element.

5. The electrophotographic imager of claim 4, wherein the development state includes a location on the development element and a relative age of non-development at the location.

6. The electrophotographic imager of claim 1, the controller to selectively apply the exposure adjustment factor to a plurality of printable areas arranged in series along the latent image in the direction of media travel, and wherein the plurality of printable areas includes the first printable area, and wherein each different printable area corresponds to a respective non-developed area of a plurality of non-developed areas of the development element.

7. The electrophotographic imager of claim 1, wherein the exposure adjustment factor for at least a first development of a respective printable area of the series of printable areas has a first value, and wherein the exposure adjustment factor for at least some subsequent developments of successive printable areas in the series have a second value different than the first value.

8. The electrophotographic imager of claim 1, wherein a decision whether to selectively apply the exposure adjustment factor is at least partially based on a recharge interval of the development element and a recharge rate by which the development element is recharged for each recharge cycle.

9. The electrophotographic imager of claim 1, wherein a decision whether to selectively apply the exposure adjustment factor is at least partially based on a threshold against which the pixel density of the first printable area is compared.

10. The electrophotographic imager of claim 1, wherein the magnitude of the exposure factor is determined based on the marking agent transfer demand, lessening overdevelopment resulting from excess marking agent being transferred onto the photoconductive element due to undercharging of the marking agent caused by the marking agent transfer demand.

11. The electrophotographic imager of claim 1, wherein the magnitude of the exposure factor is determined based on the development state of the development element, lessening underdevelopment resulting from insufficient marking agent being transferred onto the photoconductive element due to overcharging of the marking agent caused by the development element continuously running without development of the marking agent.

12. An electrophotographic imager control portion comprising:

a processor, in association with instructions stored in a memory, to selectively apply an exposure adjustment factor on a photoconductive element at a first printable portion of a latent image on the photoconductive element, wherein a decision whether to apply, and a magnitude of, the exposure adjustment factor is based on an image-dependent marking agent transfer demand regarding a first evaluation portion of the latent image preceding the first printable portion and a development state of a first development portion of a development element associated corresponding to the first evaluation portion, wherein the marking agent transfer demand indicates the volume of marking agent to be transferred via development of the first evaluation portion of the latent image, the volume of marking agent based on a pixel density parameter of a printable portion of the latent image, and wherein the development state of the development element is based on a location on the development element with respect to the volume of the charged marking agent and with respect to an age since last development usage at the location on the development element.

13. The electrophotographic imager control portion of claim 12, wherein the development element is a development element, with the memory to store a map, on a pixel-by-pixel basis, regarding the development state of the developer element, wherein a size of the map corresponds to a surface area of one cycle of the development element, and wherein the development state includes a location and an age of the non-developed area.

14. The electrophotographic imager control portion of claim 12, wherein the first evaluation portion is at least one of:

a non-printable portion with the first development portion having a development state in which no development has occurred for a number of development cycles of the development element; and a printable portion for which the marking agent transfer demand exceeds a threshold.

15. The electrophotographic imager control portion of claim 12, wherein the magnitude of the exposure factor is determined based on the image-dependent marking agent transfer demand.

16. The electrophotographic imager control portion of claim 12, wherein the magnitude of the exposure factor is determined based on the development state of the development element.

17. The electrophotographic imager control portion of claim 12, wherein the magnitude of the exposure factor is determined based on both the image-dependent marking agent transfer demand and the development state of the development element.

18. A method of manufacturing an electrophotographic imager comprising:

arranging a light source to expose areas of a chargeable surface of a photoconductive element to form a latent image, including arranging the light source to be controllable to selectively apply a first exposure adjustment factor to a first printable portion of the latent image and to selectively apply at least one second exposure adjustment factor to at least one subsequent printable portion of the latent image; and arranging a development element to be coupled relative to the photoconductive element to develop the latent image on the photoconductive element with a marking agent, wherein the respective first and second exposure adjustment factors are based at least on a magnitude of a pixel density of a first evaluation portion of the latent image preceding the first printable area and a development state of the development element, wherein the marking agent transfer demand indicates the volume of marking agent to be transferred via development of the first evaluation portion of the latent image, the volume of marking agent based on a pixel density parameter of a printable portion of the latent image, and wherein the development state of the development element is based on a location on the development element with respect to the volume of the charged marking agent and with respect to an age since last development usage at the location o the development element.

19. The method of claim 18, wherein the first evaluation portion corresponds to at least one development portion of the development element for which development has not occurred for a number of cycles exceeding a threshold.

20. The method of claim 19, wherein the magnitude of at least the first exposure adjustment factor is further based at least on a pixel density of the first printable portion of the latent image, a location of the at least one development portion, and a magnitude by which the number of cycles exceeds the threshold.

* * * * *